United States Patent [19]

Miller, deceased et al.

[11] Patent Number: 4,875,722

[45] Date of Patent: Oct. 24, 1989

[54] EXIT DEVICE ACTUATOR AND DOGGER

[75] Inventors: Theodore H. Miller, deceased, late of New Britain, Conn., by Cecelia B. Miller, executrix; Ronald S. Slusarski, Berlin, Conn.

[73] Assignee: Emhart Industries, Inc., Farmington, Conn.

[21] Appl. No.: 252,837

[22] Filed: Oct. 3, 1988

Related U.S. Application Data

[62] Division of Ser. No. 902,907, Sep. 2, 1986, Pat. No. 4,801,163.

[51] Int. Cl.[4] ..... E05B 65/10

[52] U.S. Cl. ..... 292/92; 292/201; 70/92

[58] Field of Search ..... 292/21, 92, 210, 201, 292/216, DIG. 66, 169.13, 167.14, 169.17; 70/92, 150, 279, 280

[56] References Cited

U.S. PATENT DOCUMENTS

| | | | |
|---|---|---|---|
| 2,325,225 | 2/1943 | Burke | 292/201 X |
| 3,386,761 | 6/1968 | Johnstone | 292/201 |
| 3,751,088 | 8/1973 | Schlage et al. | 292/201 |
| 3,767,238 | 10/1973 | Zawadzki | 292/92 |
| 3,917,330 | 11/1973 | Quantz | 292/201 X |
| 4,237,711 | 12/1980 | Kambil | 70/150 |
| 4,268,076 | 5/1981 | Itoi | 292/201 X |
| 4,351,552 | 9/1982 | Vander Linden | 272/201 |
| 4,406,487 | 9/1983 | Stendal | 292/201 |
| 4,573,333 | 3/1986 | Choi | 292/210 X |
| 4,593,543 | 6/1986 | Stefanek | 292/169.13 X |

*Primary Examiner*—Gary L. Smith
*Assistant Examiner*—Eric K. Nicholson
*Attorney, Agent, or Firm*—Barry E. Deutsch

[57] ABSTRACT

An electrically operated exit device comprises a low powered dogging assembly for a pushbar and an electrical actuator for a latch bolt. A latching bracket is attached to the pushbar for movement inwardly and outwardly along a path. A dogging plate of the dogging element is pivotally moveable between a retracted position out of the path of the latching element and an extended position in the path of the latching element. The dogging plate is spring biased toward the extended position and has a protruding shoulder. When the dogging plate is extended and the pushbar moved inward manually, the latching bracket strikes the dogging plate, retracts it slightly against the force of the spring bias and then continues slightly beyond the shoulder of the dogging plate. Then, the dogging plate again extends fully under the influence of the spring bias such that a bearing surface on the far side of the shoulder catches the latching bracket and thereby dogs the pushbar. The electric latch bolt actuator is coupled to a deadbolt by a first linkage assembly and to the latch bolt by the second linkage assembly and simultaneously manipulates the deadbolt and latch bolt to free the door.

6 Claims, 6 Drawing Sheets

FIG. 6
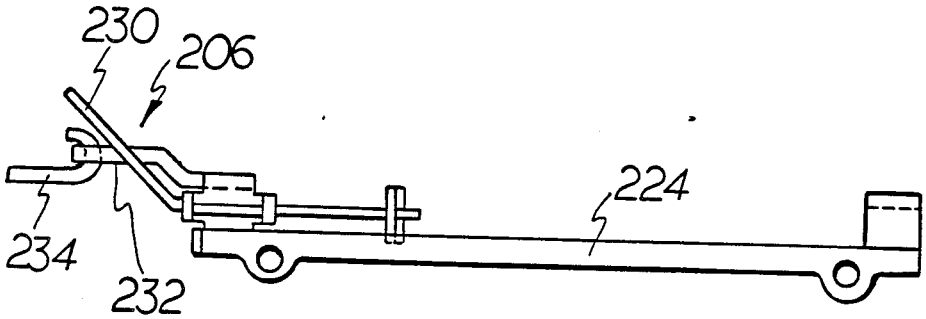
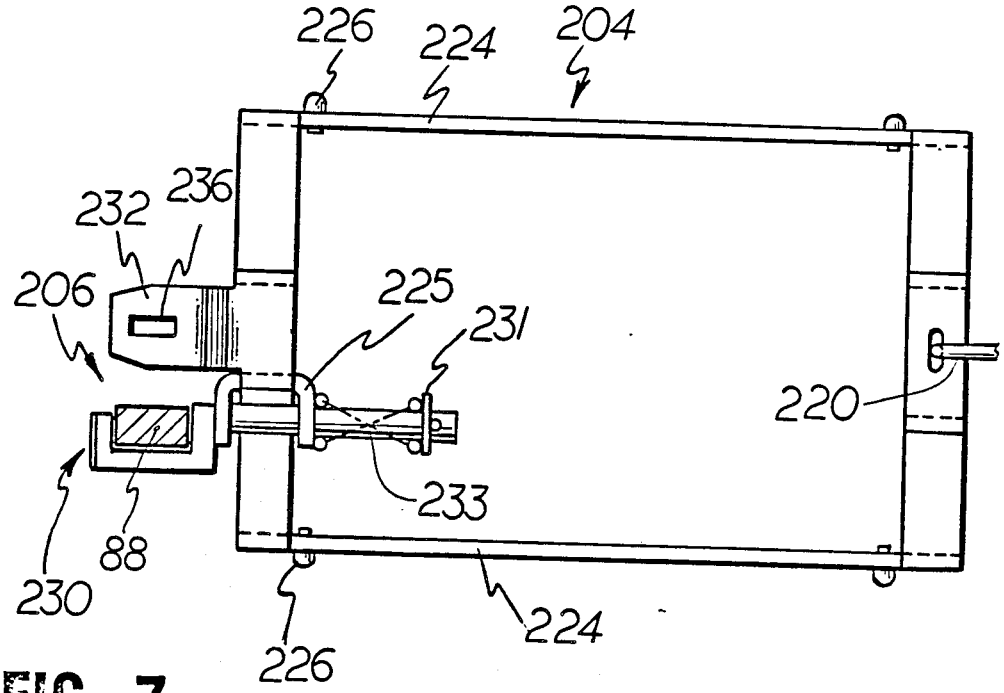
FIG. 7

EXIT DEVICE ACTUATOR AND DOGGER

This is a divisional of co-pending application Ser. No. 902,907 filed on Sept. 2, 1986 now U.S. Pat. No. 4,801,163.

BACKGROUND OF THE INVENTION

The invention relates generally to exit devices and deals more particularly with an exit device which is manually operable from the inside by a pushbar or electrically controllable by a low power dogging assembly for holding down the pushbar, and an electromechanical actuator for operating a latch bolt.

Although the dogging and actuating components of the present invention have wide usage, they may be combined with an exit device disclosed in U.S. Pat. No. 3,877,262. The patented exit device is operable from the inside of a door by manual depression of a pushbar which is coupled to a latch bolt, by a push button on the inside of the door or by a doorknob on the outside of the door. A manually operated dogging mechanism is provided to hold down the pushbar. The patented dogging mechanism is spring biased to an outward position and includes a housing mounted to the pushbar which housing provides a journal for a rotary part disposed with its axis normal to the longitudinal axis of the pushbar. The rotary part has an eccentric cam, and a hexagonal slot adapted to receive a hexagonal key used to turn the rotary part. Rotation of the rotary part in a clockwise direction from its undogged position brings the cam into engagement with an abutment surface of a keeper which is mounted to a frame. The frame is fixedly mounted to the door. The keeper includes an inner aperture, and depression of the pushbar drives the rotary part inwardly and the cam into alignment with the keeper aperture. Further rotation of the cam causes it to enter the aperture and thereby prevent the pushbar from returning to its outward position under the influence of the springs.

Such a dogging mechanism is useful during heavy access times such as at the start and end of a work shift and during emergencies to facilitate entry and exit through the door and to lessen the wear on the movable parts associated with the pushbar and latch.

Another previously known exit device of this general type is operable from the inside of the door by manual depression of a pushbar coupled to a door latch or by retraction of the pushbar directly by a solenoid. The solenoid may also be used to dog the pushbar in its retracted position during heavy usage or emergencies. The pushbar has a substantial mass and is spring biased to its outward position so that the solenoid must provide a substantial force to retract the pushbar. Consequently, the solenoid requires substantial electrical power to operate which power must be supplied to the movable door. Because of the magnitude of the power required, convenient hinge connectors cannot be utilized to supply the power to the solenoid, and instead, an undesirable external cable is required. In addition, the solenoid dissipates substantial energy into the exit device.

Accordingly, a general object of the present invention is to provide a low power, electrically operated exit device.

Another general object of the present invention is to provide an electrically actuated dogging assembly for an exit device having a pushbar which dogging assembly requires less power to operate than the aforesaid previously known electric dogging device.

Another general object of the present invention is to provide a dogging assembly of the foregoing type which is adaptable to exit devices having operating mechanisms other than pushbars.

Still another general object of the present invention is to provide an electromechanical actuator which is adaptable to an exit device of the type disclosed in the U.S. Pat. No. 3,877,262 as well as other type of exit devices.

A more specific object of the present invention is to provide a dogging assembly and an electromechanical actuator of the foregoing types which are compatible with one another for installation in a single exit device.

SUMMARY OF THE INVENTION

The invention resides in a dogging assembly for an exit device having a latch bolt, a pushbar mechanically coupled to retract the latch bolt and supported for movement from a normal, outward position to an inward position where it operates the latch bolt, and biasing means for biasing the pushbar toward its outward position. A latching element is connected to the pushbar for movement inwardly and outwardly therewith along a path, and a dogging element is supported for movement between a retracted position out of the path of the latching element and an extended position into the path of the latching element. The dogging element has a catch for the latching element which catch is operably positioned when the dogging element is positioned in the path of the latching element and the latching element is moved inwardly. An actuator moves the dogging element between its retracted and extended positions.

According to one feature of the invention, the dogging element is pivotally supported for movement between the retracted and extended positions and the actuator includes a spring for biasing the dogging element toward the extended position.

According to another feature of the invention, the dogging element has a front shoulder and a bearing surface adjoining a front edge. The shoulder and the bearing surface intersect the path of the latching element when the dogging element is positioned in its extended position so that when the latching element is moved inwardly, the latching element strikes the shoulder portion of the dogging element, temporarily retractibly moves the dogging element out of its path against the force of the actuator spring and then continues inwardly beyond the front edge of the dogging element. The dogging element then returns to its extended position under the force of the spring at which position the bearing surface catches the latching element to block the return of the latching element to its outward position and thereby dogs the pushbar.

The exit device further comprises a latch bolt supported for pivotal movement about a first axis between projected and retracted positions, and a deadlocking lever supported for pivotal movement about a second axis generally parallel to the first axis between a locking position and a non-locking position. The deadbolt has a blocker engageable with an associated portion of the latch bolt when the latch bolt is in its projected position and the deadlocking lever is in its locking position for deadlocking the latch bolt in its projected position. According to another feature of the invention, an electromechanical actuator is provided for the exit device which actuator comprises a solenoid having a plunger moveable between first and second end positions along a third axis in a plane approximately perpendicular to planes containing the first and second axes. A first linkage assembly is coupled between the deadlocking lever and the solenoid for manipulating the deadlocking lever and a second linkage assembly is coupled between the solenoid plunger and the latch bolt for manipulating the latch bolt such that when the solenoid plunger is moved to one of its end positions, the deadlocking lever is pivoted to its non-locking position and the latch bolt is pivoted to its retracted position.

According to another feature of the invention associated with the actuator, the displacement by the first linkage assembly in the direction of the third axis during movement of the deadlocking lever to is non-locking position is less than the displacement of the second linkage assembly in the direction of the third axis during movement of the latch bolt to its retracted position. The first linkage assembly comprises means for slipping itself relative to the second linkage assembly during said movement of the plunger to accommodate the lesser amount of displacement required of the first linkage assembly.

BRIEF DESCRIPTION OF THE FIGURES

FIG. 6 is a fragmentary, top view of a sled assembly of an electromechanical actuator of the exit device of FIG. 1.

FIG. 7 is a side view of the sled assembly of FIG. 6.

DETAILED DESCRIPTION OF THE PREFERRED EMBODIMENTS

In the Figures and following description, the electric dogging and latch bolt actuating features of the present invention are described in combination with portions of an exit device which is generally described in the U.S. Pat. No. 3,877,262. The U.S. Pat. No. 3,877,262 issued on Apr. 15, 1975 is assigned to the assignee of the present invention and is hereby incorporated by reference as part of the present disclosure. Accordingly, many of the elements 14–110 described below are either similar or identical to the corresponding parts disclosed in the aforesaid patent. However, it should be clearly understood that the present invention has other applications and is not limited to combination with the exit device disclosed in the U.S. Pat. No. 3,877,262.

Figure 1:
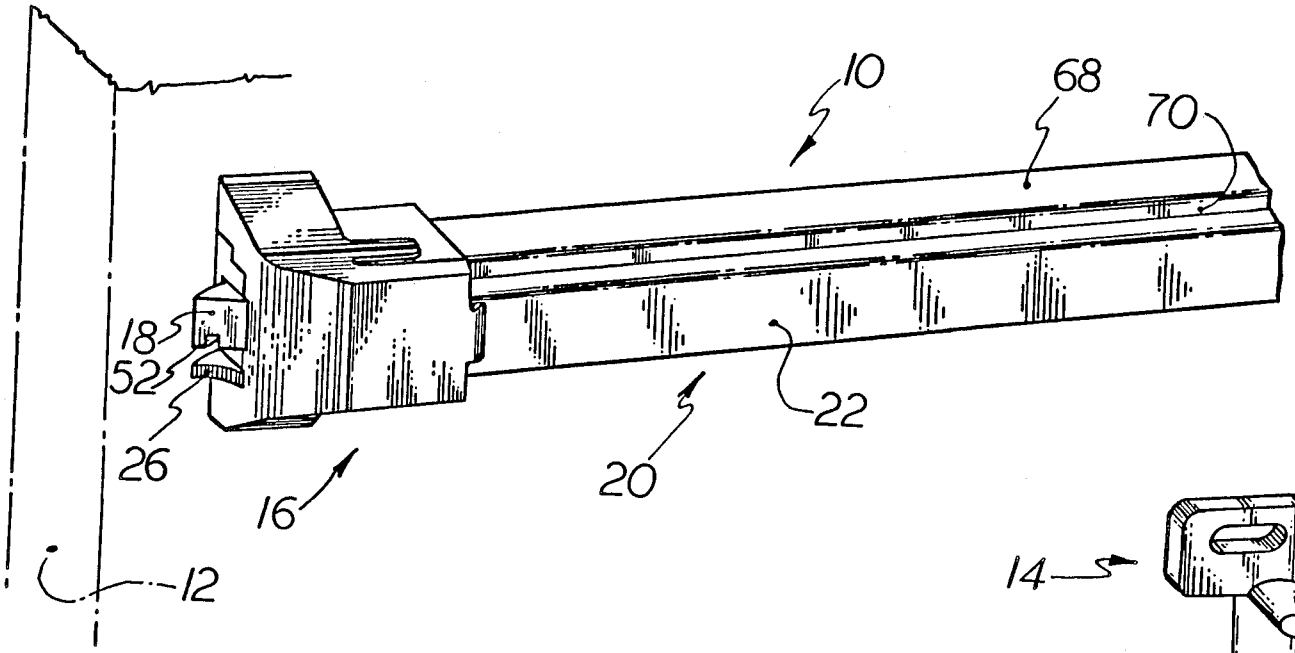
FIG. 1 is a perspective view of an exit device in which the invention is embodied, the exit device being mounted on the inner face of an outwardly opening door.
Figure 5:
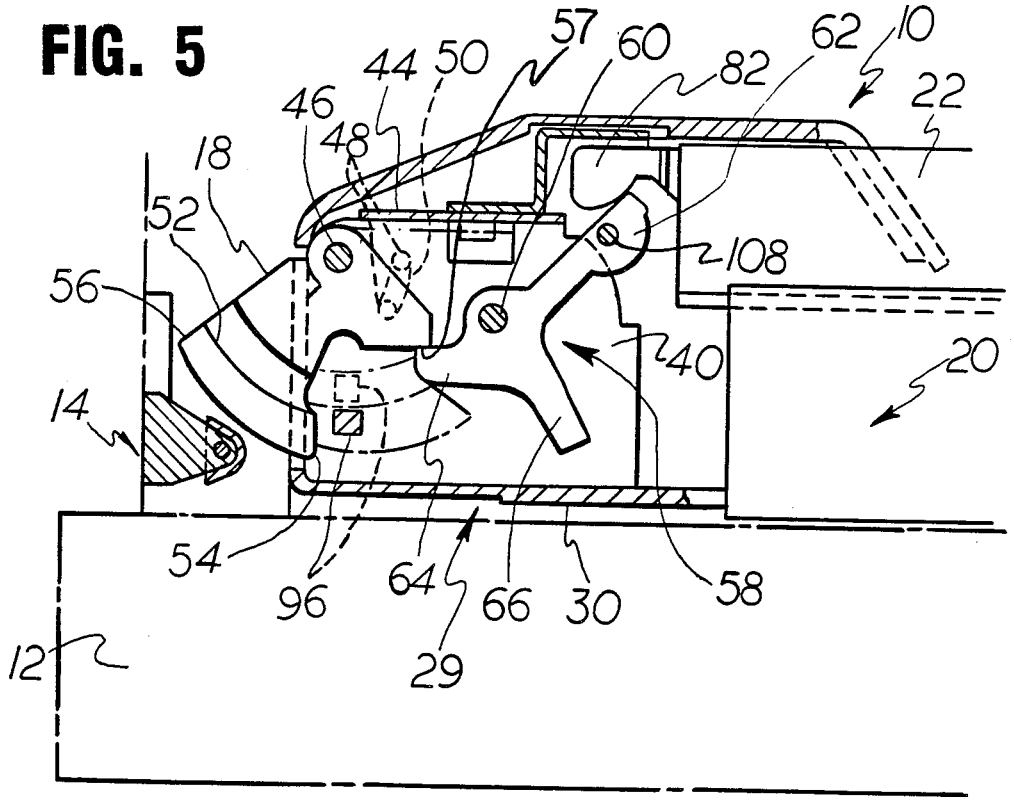
FIG. 5 is a fragmentary sectional bottom view taken along the line 5—5 of FIG. 3, and also shows the exit device mounted in an operative position on the inner face of the door with the strike assembly of FIG. 2 being shown mounted on a door frame.

Turning now to FIG. 1, a pushbar operated exit device assembly embodying the present invention is indicated generally by the reference numeral 10. The exit device 10 is shown mounted on the inner surface of an outwardly opening door 12 for engagement with a strike assembly which is indicated generally at 14 and mounted in an operative position on a frame of the door 12, as shown in FIG. 5. The exit device 10 comprises a latch bolt mechanism designated generally by the numeral 16 which includes a latch bolt 18 and an operating mechanism indicated generally at 20 which includes a pushbar 22. The pushbar 22 is mounted in a horizontal position on the door to span a substantial portion of the door width and is operable at all times. A slight pressure on the pushbar 22 will instantly retract the latch bolt to release it from engagement with the strike assembly 14 to release the door 12 and allow immediate egress.

Figure 4:
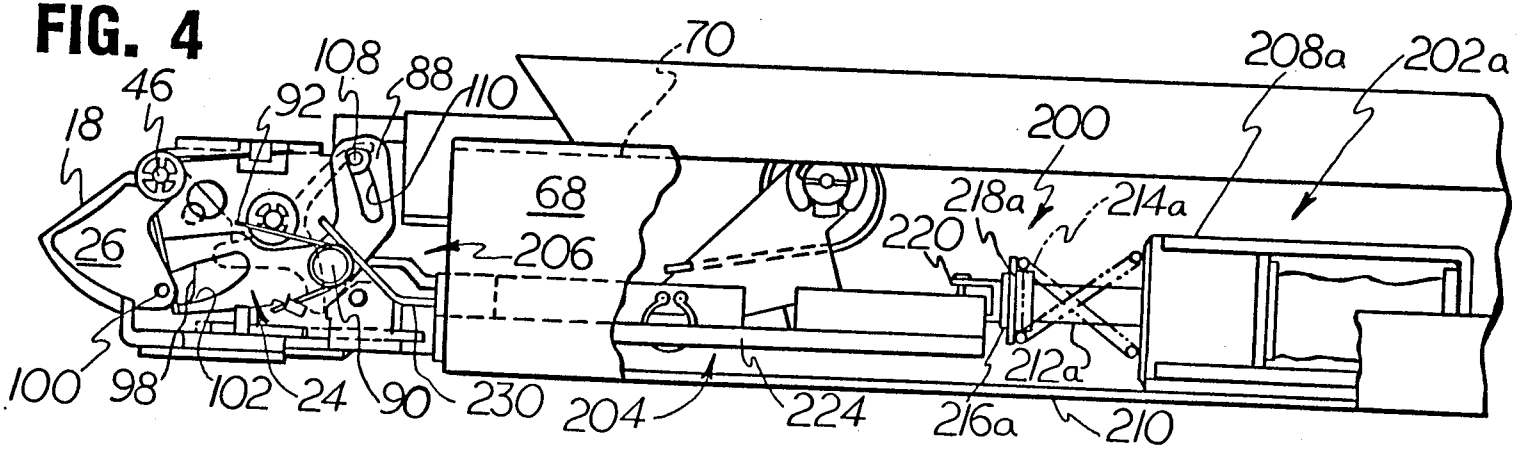
FIG. 4 is a fragmentary bottom view of the exit device of FIG. 1 with other cover portions broken away to reveal internal parts.

The exit device 10 further includes a deadlocking mechanism indicated generally at 24 and best shown in FIG. 4 for deadlocking the latch bolt when the door is closed and the latch bolt 18 is projected. The deadlocking mechanism 24 includes an auxiliary bolt 26 which cooperates with the strike assembly 14 in a manner well known in the art.

LATCH BOLT MECHANISM

Figure 3:
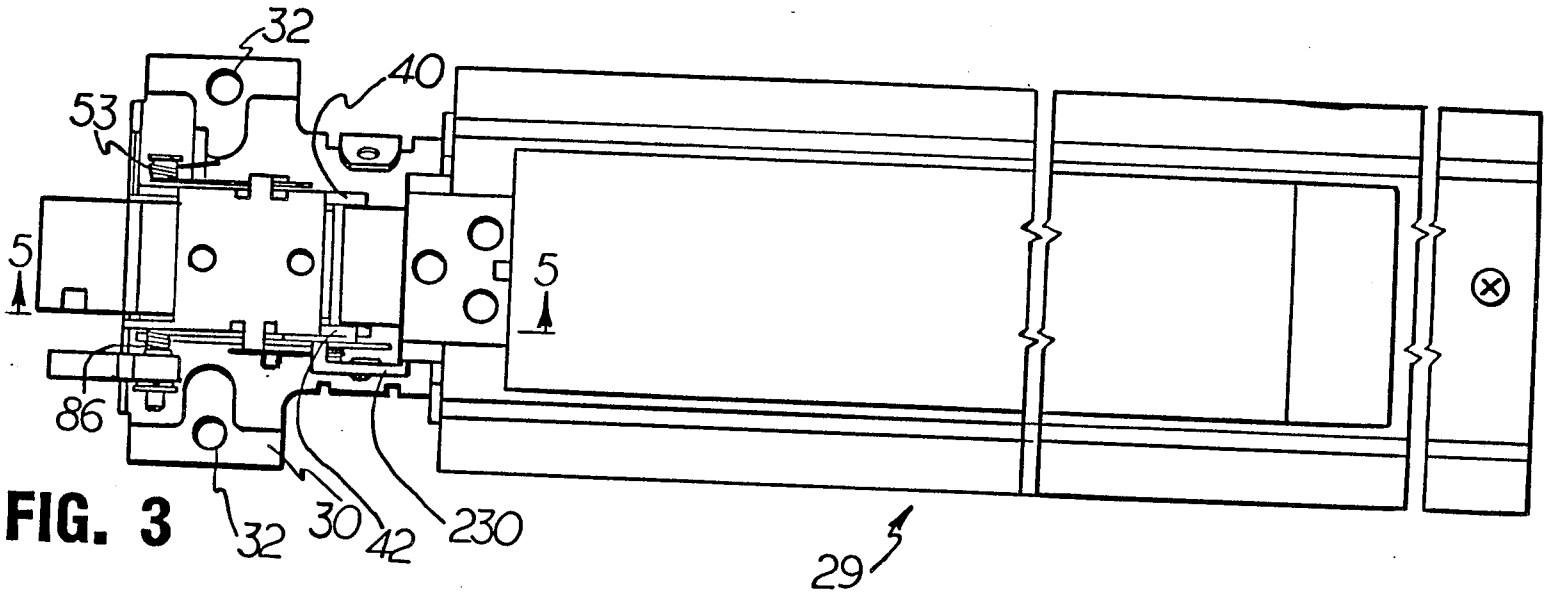
FIG. 3 is a somewhat enlarged fragmentary, side elevational view of the exit device of FIG. 1 with a cover portion removed to reveal internal components.

Considering now the latch bolt mechanism in further detail, and referring particularly to FIG. 3–5, the mechanism 16 comprises a frame 29 which includes a mounting plate 30 and a generally U-shaped support bracket. The bracket is mounted on the plate 30 and includes top and bottom walls respectively indicated at 40 and 42 staked or otherwise suitably secured to the plate 30 and integrally connected at their inner ends by an inner end wall 44. Thus, the mounting plate 30 and the U-shaped support bracket cooperate to form a box-like structure which opens rearwardly or toward the pushbar 22.

The latch bolt 18 is pivotally supported within the box-like frame by a vertically disposed pivot pin 46 which extends through the latch bolt and through and beyond the top and bottom walls 40 and 42. A pin 48 mounted on the latch bolt 18 extends upwardly therefrom and through an arcuate slot 50 formed in the top wall 40. A torsion spring 53 mounted on the pivot pin 46 above the top wall 40 acts between the pin 48 and the frame to bias the latch bolt 18 in a clockwise direction toward its projected position, as viewed from below in FIGS. 4 and 5. The slot 50 cooperates with the pin 48 to limit angular movement of the latch bolt 18 between its projected or full line position and its retracted or broken line position of FIG. 5. An arcuate groove 52 opens through the bottom surface of the latch bolt and has its center of curvature at the center of the pivot pin 46. The latch bolt further includes a generally vertically disposed abutment surface 54 which faces rearwardly and a generally vertically disposed bearing surface 56 which faces outwardly or toward the door 12 when the latch bolt is in its projected position, as best shown in FIG. 5.

Operative connection between the latch bolt 18 and the pushbar 22 is provided by a retractor element or lever 58 (FIG. 5) supported within the frame by a pivot pin 60 which extends through the retractor lever 58 in parallel alignment with the pivot pin 46 and has its upper and lower ends respectively supported in the upper and lower walls 40 and 42. The retractor lever 58 includes three angularly spaced parts or legs designated 62, 64 and 66 which extend outwardly in generally radial directions from the pin 60. As shown in FIG. 5, the leg 64 is engageable with a second bearing surface 57 on the latch bolt to pivot it in a counterclockwise direction to cause retraction.

PUSHBAR ASSEMBLY

Figure 9:
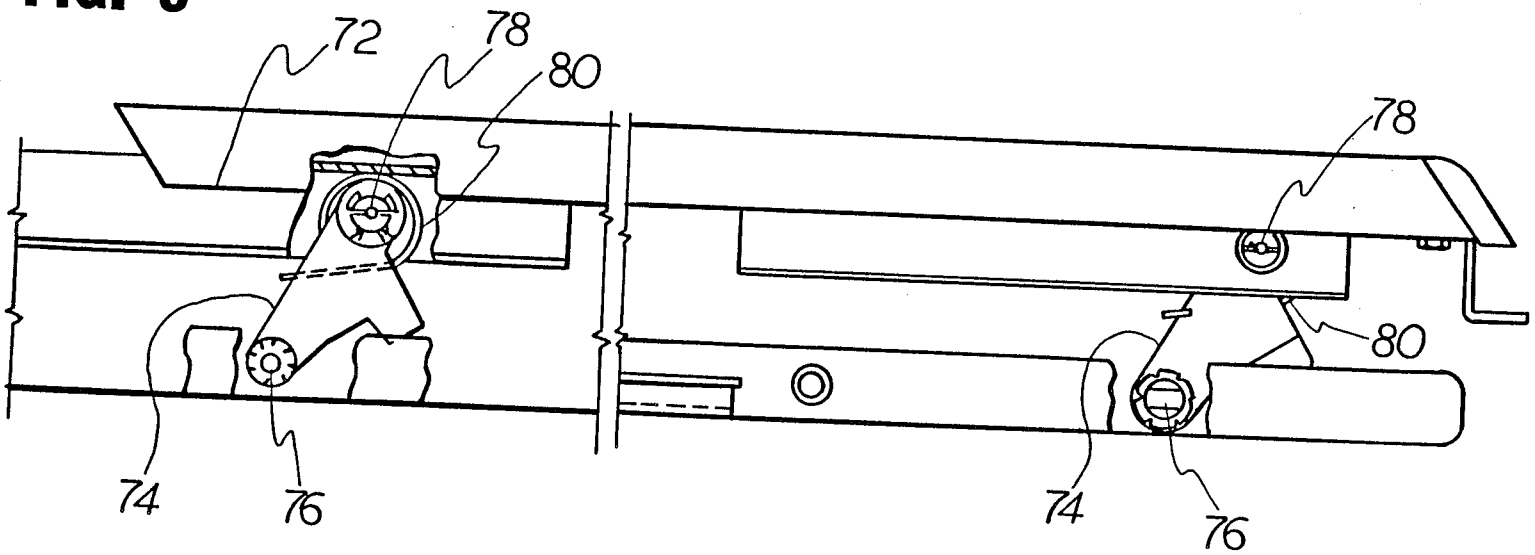
FIG. 9 is a fragmentary, bottom view of the exit device of FIG. 1 and shows a pushbar assembly.

Considering now the pushbar assembly 20 in further detail and referring to FIGS. 4, 5 and 9, the assembly 20 includes a horizontally elongated channel member 68 secured to the mounting plate 30 to form a rearward extension of the latch bolt mechanism frame. The channel member 68 opens inwardly and has longitudinally extending lips 70, 70 at its inner end which define the channel opening. The pushbar 22 is telescopically received within the opening in the channel member 68 and has longitudinally extending flanges 72, 72 at its outer end for respectively engaging the lips 70, 70 as best shown in FIG. 9. The pushbar 22 is supported in the channel member 68 by a pair of parallel links 74, 74 which are supported by pivot pins 76, 76 to pivot about axes parallel to the axis of the latch bolt 18. Each link 74 is further connected to the pushbar 22 by another vertically disposed pivot pin 78 which extends through the inner end of the link and is mounted on the upper and lower walls of the pushbar 22. Each link 74 has a torsion spring 80 associated therewith which acts between the link and the pushbar 22 to bias the pushbar to its extended or outward position. At its forward end, the pushbar 22 carries an actuator element or retractor finger 82 (FIG. 5) which is secured thereto by suitable fasteners, and is adapted for engagement with the retractor leg 62 as best shown in FIG. 5.

When the pushbar 22 is biased to its outward position, the flanges 72, 72 respectively engage the lips 70, 70. A slight pressure exerted upon the pushbar toward the door 12 causes the pushbar to pivot or move in an arcuate path inwardly toward its depressed or broken line position of FIG. 10. The retractor finger 82 which engages the retractor lever leg 62 causes the retractor lever 58 to pivot in a clockwise direction, as it appears in FIG. 5. The latter clockwise movement of the retractor lever 58 causes a generally corresponding counterclockwise movement of the latch bolt 18 due to coengagement of the leg 64 and the bearing surface 56 to pivot the latch bolt 18 toward its retracted or released position relative to the strike assembly 14 and to release the door and allow it to move to its open position. As the door closes the inclined surface on the face of the latch bolt 18 engages the strike assembly 14 to pivot the latch bolt toward its retracted position. When the latch bolt 18 clears the strike assembly 14, and the door 12 has attained its fully closed position, the latch bolt is again biased to its projected position by the torsion spring 53.

DEADLOCKING MECHANISM the deadlocking mechanism 24 will now be more fully considered with particular reference to FIGS. 3 and 4. As previously noted, the deadlocking mechanism includes an auxiliary latch bolt 26, the latter bolt being mounted on the lower end of the pivot pin 46 and below the bottom wall 42. A torsion spring 86 encircles the pin 46 between the auxiliary bolt 26 and the bottom wall 42 and acts between a tab formed on the bottom wall and the auxiliary bolt to bias the latter bolt to a projected position. The auxiliary bolt 26 is pivotably movable between projected and retracted positions and cooperates with the strike assembly 14 to control movement of a generally L-shaped deadlocking plate or lever 88 mounted on a stud 90 supported on the bottom wall 42. The deadlocking lever 88 pivots on the stud 90 about an axis generally parallel to the axis of the latch bolt 18 and auxiliary bolt 26.

A torsion spring 92 mounted on the stud 90 acts between a tab on the lever 88 and the lower end of the pivot pin 60 to bias the deadlocking lever 88 in a counterclockwise direction and toward a deadlocking position, as viewed from below in FIG. 4. The deadlocking lever carries a blocker or post 96 at its forward end (FIG. 5) which projects upwardly through an aperture 98 in the bottom wall 42. The auxiliary bolt 26 carries a control pin 100 received in a cam slot 102 in the deadlocking lever 88. The control pin 100 cooperates with a cam surface defined by the slot 102 to move the spring biased deadlocking lever 88 to an inactive or unlocked position when the door is opened and the auxiliary bolt 26 moves to its projected position and to hold the deadlocking lever 88 in its unlocked position while the door remains in an open position. The post 96 is aligned with the arcuate groove 52 in the latch bolt 18 when the deadlocking lever 88 is in its unlocked position to permit free pivotal movement of the latch bolt, as shown in broken lines in FIG. 5. However, the blocker 96 is out of alignment with the groove 52 in a blocking position shown in full lines in FIG. 5, when the deadlocking lever 88 is in its locking position. In the latter position, the post 96 is disposed rearwardly of the abutment surface 54 to prevent pivotal movement of the latch bolt 18 toward its retracted position.

Figure 2:
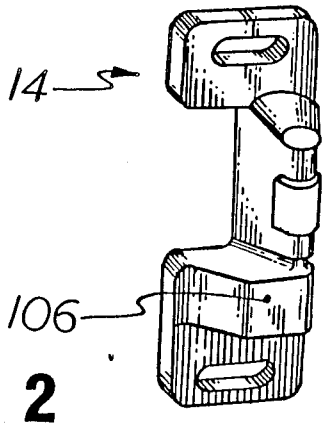
FIG. 2 is a somewhat enlarged perspective view of a strike assembly for use with the exit device of FIG. 1.

As the door 12 is moved toward a closed position, both the latch bolt 18 and the auxiliary bolt 26 move to retracted positions upon engagement with the strike assembly 14. The latch bolt leads the auxiliary bolt slightly and engages the strike assembly 14 before the auxiliary bolt engages it. Accordingly, the post 96 which is held in its inactive position by the projected auxiliary bolt 26 enters the slot 52 before the auxiliary bolt engages the strike assembly 14 to release the deadlocking lever 88 from its unlocked position. Thus, the latch bolt 18 is free to pivot to its fully retracted position in engagement with the strike assembly 14 as the door closes. When the door attains its fully closed position and the latch bolt 18 clears the strike assembly 14, the torsion spring 53 biases the latch bolt to its projected position. However, the auxiliary bolt 26 is retained in its retracted position by engagement with an abutment surface 106 on the strike assembly, the latter abutment surface being best shown in FIG. 2. When the auxiliary bolt 26 is retracted, the control pin 100 is disposed in the rear portion of the cam slot 102 and allows the deadlocking lever 88 to pivot or rock slightly in a counterclockwise direction under the biasing force of the spring 92, as it appears in FIG. 4, to move the post 96 to its blocking or full line position shown in FIG. 5. In the latter position, the post 96 is disposed rearwardly of the abutment surface 54 to prevent movement of the latch bolt 18 to its retracted position.

Movement of the deadlocking lever 88 is further controlled by a drive pin 108 which projects from the retractor leg 62 and extends into and through another cam or control slot 110 in the inner end of the retractor lever 88. Initial pivotal movement of the retractor lever 58, as in response to depression of the pushbar 22, causes the pin 108 to cooperate with a cam surface defined by the inner end portion of the control slot 110 to pivot the deadlocking lever 88 in a clockwise direction and toward its release or unlocked position, as viewed in FIG. 4. The pin 108 then enters the main arcuate portion of the slot 110 wherein it is free to travel as the retractor lever 58 moves to its second position. The latter pivotal movement of the retractor lever 58 causes retraction of the latch bolt with the blocker 96 disposed within the arcuate groove 52.

ELECTROMECHANICAL ACTUATING MECHANISM

Focusing now on one feature of the present invention, FIG. 4 illustrates an electromechanical actuating assembly generally designated 200 for operating the latch bolt 18. The actuating assembly 200 comprises a solenoid 202*a*, a linkage or sled 204, and a linkage assembly 206.

A body portion 208*a* of the solenoid 202*a* is fixedly attached to a frame 210, and a plunger 212a of the solenoid 202*a* is biased outwardly by a spring 214*a*. The spring 214*a* is braced between the solenoid body 208*a* and a plunger cap 216*a* via an inermediary washer 218*a*. By way of example, the solenoid 202*a* is a latching type and Model MDL-46, manufactured by Magnetec Corp. of Bloomfield. Connecticut is suitable. With the latching solenoid, after power is supplied to the solenoid, the plunger is retracted until it reaches a seating position where it is latched. At this time, because of the nature of the latching solenoid, power is no longer required to maintain the plunger in its retracted or activated state.

The sled 204 is attached to the plunger cap 218*a* via a bracket 220 and includes longitudinal rail portions 224, 224 (FIGS. 6 and 7) having button guides 226, 226 for longitudinal motion of the sled 204.

The linkage assembly 206 includes a bushing 225 which is fixedly attached to the sled 204 and is in receipt of a link 230. A snap ring 231 is provided at a rear end of the link 230 and a spring 233 is braced between the snap ring and the bushing to bias the link 230 rearwardly against the bushing 225 but allow the link 230 to move in the forward, longitudinal direction relative to the sled 204 against the spring bias. A front portion of the link 230 (FIG. 7) is shown in receipt of the lever 88 (FIGS. 3 and 4) and thereby couples longitudinal motion of the plunger 212*a* to pivotal movement of the lever 88 about the pin 90.

Figure 8:
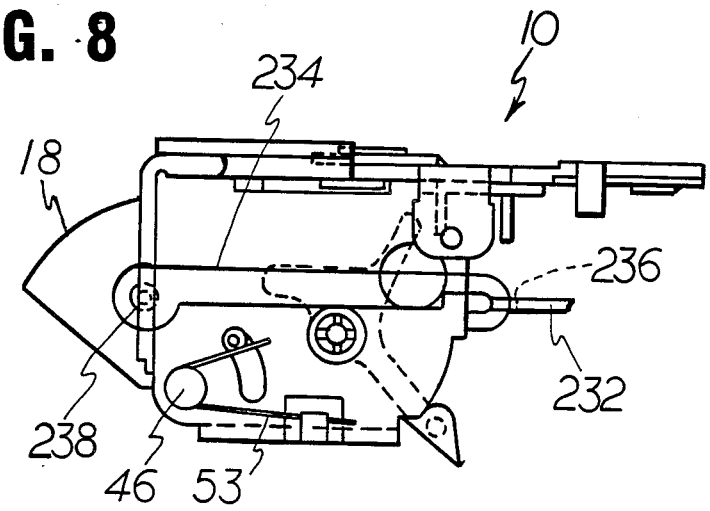
FIG. 8 is a fragmentary, top view of the exit device of FIG. 1 and shows a linkage of the actuator of FIG. 6.

As shown in FIGS. 6 and 8, the linkage assembly 206 also includes a link 232 which is fixedly attached to the sled 204, and a link 234. Front and rear ends of the link 234 are hooked shape. The rear hook end is received in an aperture 236 in the link 232. The latch bolt 18 includes a side pin 238 which projects upwardly and is captured by the front hook end of the link 234. Consequently, longitudinal motion of the plunger 212*a* and the sled 204 causes pivotal movement of the latch bolt 18 about the pin 46. Conversely, pivotal, retractile motion of the latch bolt 18 due to manual depression of the pushbar 22 or due to contact by the latch bolt 18 with the strike 14 causes longitudinal motion of the sled 204 and retraction of the plunger 212*a* against the bias of spring 214*a*. Assuming the solenoid is deactivated as shown in FIG. 4, after return of the pushbar to its normal, outward position or cessation of contact between the latch bolt 18 and the strike 14, the springs 214*a* and 53 return the latch bolt 18 to its normal, projected position.

When the solenoid 202*a* is activated, the plunger 212*a*, the sled 204*a* and the linkage assembly 206*a* are drawn to the right, according to the orientation illustrated in FIG. 4. Consequently, the first link 230 urges the deadbolt lever 88 to pivot clockwise causing the post 96 to align with the groove 52 in the latch bolt 18, and the second link 232 and third link 234 urge the latch bolt 18 to pivot in the counterclockwise direction to its retracted position. It should be noted that the longitudinal displacement of the first link 230 required to pivot the deadbolt lever 88 is less than that required to pivot the latch bolt 18. During initial retraction of the plunger 212*a*, the links 230, 232 and 234 move approximately in unison. Then, when the deadlocking lever arm 88 reaches its non-locking position, the link 230 ceases to retract while the links 232 and 234 and the sled 204 continue to retract. Consequently, the bushing 225 slides toward the snap ring 231 compressing the spring 233 so that the spring 233 accomodates the necessary slippage between the link 230 and the sled 204 to allow the links 232 and 234 to retract further than the link 230.

The aforesaid actuation of the solenoid 202a may be a result of a control signal sent by a master computer (not shown) or by a microprocessor associated with a key card reader (not shown).

The solenoid 202*a* may be deactivated by another control signal which unseats the plunger and allows it to extend under the influence of the spring 214*a*. Upon deactivation of the solenoid 202*a*, the latch bolt 18 returns to its normal, extended position under the influence of the spring 214*a*, and the deadbolt 26 returns to its blocking position by the springs 214*a*, 233 and 92 provided that the door is closed.

DOGGING ASSEMBLY

Figure 11:
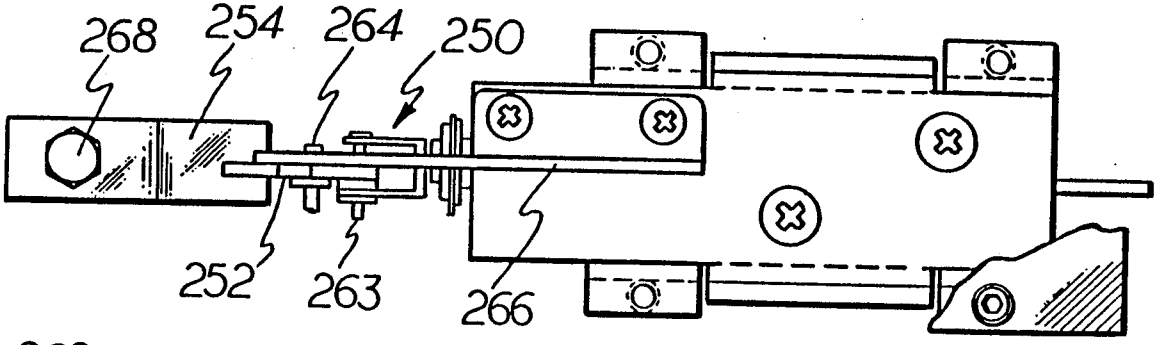
FIG. 11 is a fragmentary, side view of the dogging assembly of FIG. 10.
Figure 10:
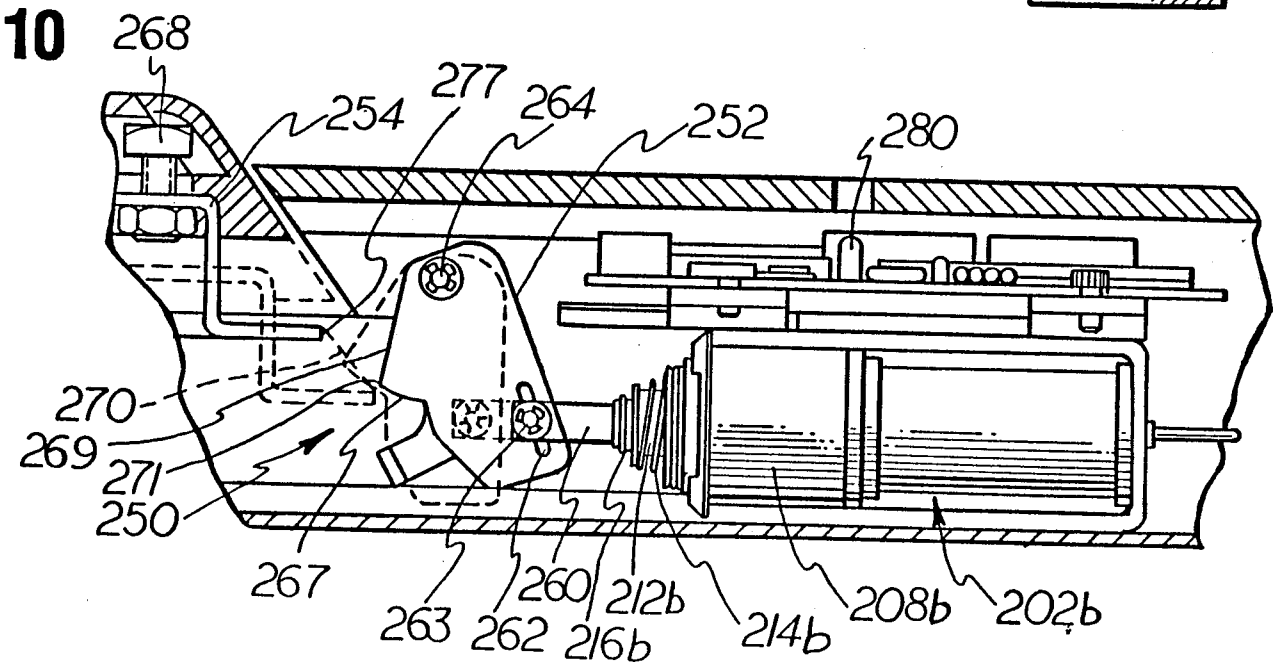
FIG. 10 is a fragmentary, bottom view of the exit device of FIG. 1 with parts broken away to reveal a dogging assembly.

Focusing now on another feature of the present invention, FIGS. 10 and 11 illustrate a dogging assembly generally designated 250 for retaining the pushbar in a depressed position corresponding to a retracted position of the latch bolt 18. In the dogged condition, the door is released and is free to be pulled open from the outside, or pushed open from the inside with or without contacting the pushbar 22. The dogging assembly may be utilized during heavy usage times of the day, for example, at the start and close of a workshift to minimize wear on the moving parts of the exit device and also during emergency conditions. The solenoid 202*b* may be controlled by the aforesaid master computer which may itself be coupled to a smoke detector or other alarm system to activate the dogging assembly under emergency conditions.

The dogging assembly 250 comprises a solenoid 202*b* and a dogging element or retaining plate 252. An electrical door hinge connector (not shown) delivers power to the solenoid 202*b*. By way of example, the solenoid 202*b* is identical to the solenoid 202*a*, and a body portion 208*b* of the solenoid 202*b* is fixedly attached to the frame 210. In FIG. 10, the plunger 212*b* is shown in solid line in a retracted, activated position in which it is internally latched or seated.

A link 260 rigidly extends from a plunger cap 216*b* and is connected to the retaining plate 252 by a screw 263 extending through a slot 262 in the retaining plate 252. The retaining plate 252 pivots about a pin 264 which pin is supported vertically, perpendicular to the plane of motion of the pushbar 22 by a bracket 266 so that longitudinal (horizontal) motion of the plunger 212*b* causes pivotal motion of the retaining plate 252.

The retaining plate 252 includes a retaining or bearing surface 267 which adjoins a front edge 269, and a shoulder 271 which also adjoins the front edge 269. A latching element or bracket 254 is fixedly attached to the pushbar 22 by a bolt 268, and the bearing surface 267 serves retain the latching bracket 254 under certain conditions described below.

In FIG. 10, the pushbar 22 is shown in its outward position and the latching bracket 254 is well separated from the retaining plate 252. Upon depression of the pushbar 22, the latching bracket 254 follows the angular path of the pushbar as indicated by an arrow 270 and after full depression, assumes the position indicated in broken lines. If the plunger **212*b* is retracted (actuated) as illustrated, the retaining plate 252 is still separated from the latching bracket 254 so that no retention or dogging of the pushbar 22 occurs. Upon manual release of the pushbar 22, it springs back to its outward position under the influence of the biasing springs 80, 80. Consequently, when the solenoid 202*b* is retracted, the pushbar 22** may be utilized to release the door and no dogging takes place.

When the solenoid **202*b* is subsequently deactivated so that the plunger 212*b* extends outwardly under the influence of the spring 214*b*, the retaining plate 252 is pivoted clockwise to a position indicated in broken line in FIG. 10 so that the front edge 269 crosses the angular path 270 of the latching bracket 254. At this time, the retaining plate 252 is biased against counterclockwise pivoting by the spring 214*b* and is in a "cocked" position ready to receive and retain the latching bracket 254 and thereby dog the pushbar 22. Then, when a person manually depresses the pushbar 22, the latching bracket 254 is moved inwardly along the angular path 270 and a leading edge 277 of the latching bracket 254 strikes the front shoulder portion 271 of the retaining plate 252 and thereby drives the retaining plate to pivot slightly in the counterclockwise direction. The motion of the pushbar 22 is not seriously impeded by the retaining plate 252 and under normal conditions, the pushbar 22 and the latching bracket 254 continue inwardly until the latching bracket 254 attains the position indicated in broken line. At this time, the leading edge 277 of the latching bracket 254 is clear of the front shoulder 271 and front edge 269 of the retaining plate so that the retaining plate 252 springs back to the position indicated in broken line in FIG. 10 under the influence of the biasing spring 214*a*. As a result, the bearing surface 267 overlaps the leading edge 277 of the latching bracket 254. When the operator releases the pushbar 22, it springs outwardly only slightly until the latching bracket 254 engages the bearing surface 267 and at that point is held or dogged by the retaining plate against further outward motion. During such dogging, the latch 18 is held in its retracted, open position and the deadlocking lever 88** is held in its non-lacking position so that the door is free to open from the inside or outside.

To terminate the dogging and release the pushbar 22, the electronic control activates the solenoid **202*b* which retracts the plunger 212*b*. This causes the retaining plate 252 to pivot rearwardly, according to the orientation of FIG. 10, and free the latching bracket 254. Then, the pushbar 22 and latching bracket 254 move outwardly under the influence of the springs 80, 80**.

It should be noted that the power required to retractibly drive the solenoid against the bias of spring 214b and the frictional interface between the bearing surface 267 and the latching bracket 254 and to overcome the inertia of the plunger **212*b* and the retaining plate 252 is small compared to the force required to depress the pushbar 22 against the force of the springs 80, 80** and to overcome the inertia of the relatively heavy pushbar. Also, the power required to deactivate or unseat the plunger is relatively small. Because the pushbar is manually depressed to begin the dogging, the electrical power requirements of the dogging assembly of the present invention are relatively small compared to those of the electromechanical dogging assembly described in the Background of the Invention in which a solenoid is used to directly retract the pushbar, and a hinge connector may be utilized to supply the power.

Typically, when the solenoid **202*b* is extended to cock it for the dogging operation, the solenoid 202*a* is simultaneously activated to retract the latch bolt 18 and free the door. When it is desired to terminate the dogging operation, typically the solenoid 202*b* is activated to retract the retaining plate 252 and simultaneously, the solenoid 202*a* is deactivated to position the latch bolt 18** in its extended position.

An LED 280 is provided on the frame 210 facing inwardly of the door to indicate when the exit device is in the dogged or cocked position. This LED is activated by the same electronic control which activates the solenoids **202*a* and 202*b***.

By the foregoing, a dogging assembly and an electromechanical actuator for an electrically controlled exit device have been disclosed. However, numerous modifications and substitutions may be made without deviating from the scope of the invention. For example, the dogging assembly 200 may be used with a push button operator which operator is coupled to the latch bolt and provided with a latching bracket similar to the latching bracket 254. If instead of the push button or the pushbar, a pivotal door knob handle is used to operate the latch bolt 18, then a suitable slide such as the one disclosed in the aforesaid U.S. Pat. No. 3,877,267 can be used to provide a latching bracket having linear motion when the handle is turned, which latching bracket being adapted for engagement with the retaining plate of the dogging assembly.

Also, if desired, non-latching type solenoids can be substituted for the solenoids **202*a* and 202*b*** without increasing the peak power requirements.

Therefore, the invention has been disclosed by way of illustration and not limitation, and reference should be made to the following claims to determine the scope of the invention.

What is claimed is:

1. In an exit device comprising a latch bolt supported for pivotal movement about a first axis between projected and retracted positions, a deadlocking lever supported for pivotal movement about a second axis generally parallel to the first axis between a locking position and a non-locking position and having a blocker engagable with an associated portion of said latch bolt when said latch bolt is in its projected position and said deadlocking lever is in its locking position for deadlocking said latch bolt in its projected position, the improvement comprising:

a solenoid having a plunger movable along a third axis between first and second end positions, said third axis being substantially perpendicular to said first and second axes.

first linkage means coupled between said deadlocking lever and said solenoid for translating longitudinal motion of said plunger of said solenoid to pivotal motion of said deadlocking lever, second linkage means coupled between said solenoid plunger and said latch bolt for translating longitudinal motion of said solenoid plunger to pivotal motion of said latch bolt so that when said solenoid plunger is moved to said first end position, said deadlocking lever is pivoted to its non-locking position and said latch bolt is pivoted to its retracted position, the movement of said deadlocking lever from its locking position to its non-locking position causes the first linkage means to move a first distance, and the movement of said latch bolt from its extended position to its retracted position causes the second linkage means to move a second distance, with said second distance being greater than the first distance, and said first linkage means comprises means for slipping itself relative to said second linkage means during movement of said plunger to said first end position to accommodate for the movement differential between the first and second linkage means.

2. An improvement to an exit device as set forth in claim 1 further comprising:

a pin connected to said latch bolt and projecting from said latch bolt in a direction approximately parallel to said first axis of said latch bolt and wherein said second linkage means is connected to said pin of said latch bolt.

3. An improvement to an exit device as set forth in claim 1 further comprising:

third linkage means connected between said solenoid plunger and said first and second linkage means, said means for slipping said first linkage means comprising a spring connected between said first linkage means and said third linkage means to allow said first linkage means to move relative to said second and third linkage means.

4. In an exit device as set forth in claim 1 further including a pushbar mechanically coupled to retract the latch bolt and supported for movement from a normal, outward position to an inward position where it operates said latch bolt, and biasing means for biasing the pushbar toward its outward position, the improvement further comprising:

a latching element connected to the pushbar for movement inwardly and outwardly therewith along a path, a dogging element moveable between a retracted position out of said path of said latching element and an extended position into said path of said latching element for retaining said latching element when said latching element is moved inwardly, and actuating means for moving said dogging element between its retracted and extended positions.

5. An improvement to an exit device as set forth in claim 4 wherein said actuating means includes means for biasing said dogging element when in said extended position against retraction, and said dogging element has a front shoulder and a bearing surface adjoining a front edge, said shoulder and intersecting the path of said latching element when said dogging element is positioned in its extended position so that when said latching element is moved inwardly, said latching element strikes said shoulder of said dogging element, temporarily retractibly moves said dogging element out of its path against the force of the biasing means of the actuating means and then continues inwardly beyond said front edge of said dogging element, said dogging element then returning to its extended position under the force of said biasing means at which position said bearing surface retains said latching element to block the return of said latching element to its outward position and thereby dogs said pushbar.

6. An improvement to an exit device as set forth in claim 5 wherein said dogging element is pivotally connected about an axis which intersects a plane in which said latching element moves, and said actuating mechanism comprises a solenoid having a plunger coupled to said dogging element to pivot said dogging element between said extended position and said retracted position.

* * * * *